US006000159A

United States Patent [19]

Hornung

[11] Patent Number: 6,000,159

[45] Date of Patent: Dec. 14, 1999

[54] DATABLE FOOD STORAGE CONTAINERS

[76] Inventor: Lee Hornung, P.O. Box 300, Chaddsford, Pa. 19317

[21] Appl. No.: 09/015,146

[22] Filed: Jan. 29, 1998

[51] Int. Cl.[6] ..... G09F 9/00

[52] U.S. Cl. ..... 40/307; 40/311; 40/114; 116/308; 116/309; 116/316; 215/230; 220/212

[58] Field of Search ..... 40/307, 5, 114, 40/116, 113, 311, 313, 495, 506; 116/308, 309, 312, 315, 316, 317; 215/230, 228, 215; 220/212; 206/534; D19/20, 21

[56] References Cited

U.S. PATENT DOCUMENTS

| | | | |
|---|---|---|---|
| 2,296,551 | 9/1942 | Ylio . | |
| 2,492,891 | 12/1949 | Schall . | |
| 2,774,158 | 12/1956 | Tamochat . | |
| 2,916,837 | 12/1959 | Bosland | 40/114 |
| 2,945,312 | 7/1960 | Book | 116/317 X |
| 3,530,818 | 9/1970 | Secondino | 206/534 |
| 3,776,177 | 12/1973 | Bryant et al. . | |
| 3,818,858 | 6/1974 | Kramer et al. . | |
| 4,621,670 | 11/1986 | Yuen . | |
| 4,662,520 | 5/1987 | Griffin . | |
| 5,280,834 | 1/1994 | Berkley . | |
| 5,377,614 | 1/1995 | Glazer . | |
| 5,711,160 | 1/1998 | Namisniak et al. | 116/308 X |

*Primary Examiner*—Brian K. Green
*Attorney, Agent, or Firm*—Schnader, Harrison, Segal & Lewis

[57] ABSTRACT

A datable food storage container including a vessel having an upper mouth-defining structure, a vessel wall and a vessel bottom; a lid fixable to the upper mouth-defining structure, the lid having a top surface and a bottom surface, the lid having a lid cavity in the top surface; and a dating mechanism positioned in the lid cavity and releasably engaged with the lid, the dating mechanism including a plurality of generally cylindrical body members fixably rotatable about a common axis substantially parallel to the top surface of the lid, each of the body members having an outer surface which carries indicia, and a tubular shaft releasably engaged with the lid and extending through the cylindrical body members along the common axis such that the body members are fixably rotatable about the shaft.

14 Claims, 4 Drawing Sheets

DATABLE FOOD STORAGE CONTAINERS

BACKGROUND OF THE INVENTION

The present invention relates to food storage containers, in particular to food containers which incorporate a mechanism for displaying date of storage (or other indicia) information on the container.

FIELD OF THE INVENTION

Food storage containers that provide a relatively airtight seal with a snap-on tight cover are relatively well known in the art, and are usually made of plastic material. Such food storage containers may be opaque or clear, the clear containers allowing the user to view the contents of the container.

Attempts to indicate storage dates short of actual marking on the container have met with little commercial success, probably for several reasons. Generally speaking, the dating mechanisms in existing devices are complex and hard to use, are limited to use on large containers, are subject to accidental movement, are not easily replaceable, and often do not allow for the stacking of containers. For example, U.S. Pat. No. 3,818,858 discloses using a dial type indicator affixed to the side of the container to indicate a month, while the day of the month was referenced by the lid being rotated to a particular index mark. Not only was having both a dial and a lid reference complex, the dial could be very easily displaced by one or several months, thereby losing its value. A variation on these devices teaches placing a first indicia on the container, which may be days of the week or the days of the month, while a second indicia is placed on the lid of the container. In this instance, it is necessary to align the dates very carefully so that there would be no confusion between positioning the two indicia.

U.S. Pat. No. 4,621,670 teaches using a single set of indicia on a vessel, with a triangular projection on the lid acting as an indicator. The indicia are incorporated directly onto the vessel, rendering the vessels relatively expensive to manufacture. Additionally, this final variation only allows for the display of a limited number of dates on a vessel, the size of the vessel limiting the accuracy of the dating information that could be displayed.

U.S. Pat. No. 4,662,520 discloses a dating mechanism that utilizes rotating rings on the top of the container lid, the rings rotating about a rod in the center of the lid and containing date information as well as food type information. Such a mechanism is limited in numerous ways. First, use of this dating mechanism is limited to large square or circular containers wide enough to accommodate such rings. The rotating mechanism cannot be used on narrow containers, such as containers for dry spaghetti, strudel, or butter. Second, the mechanism is limited to the generic descriptors available. For instance, a user could select the "salad" indicia for either potato salad and green salad, even though they are markedly distinct foods with different shelf lives—a user would have to rely on memory or open the container to ascertain exactly what food was stored within the container. Third, such a mechanism was not practically replaceable and removable for cleaning, since removal and installation of a ring requires "forcing" the ring onto and off of a teardrop shaped member highly susceptible to wear. Also, the rotating rings on the container lid do not provide a stable surface for stacking and can be accidentally displaced when stacking is attempted.

Consequently, there is a need in the art for a datable food storage container that is reliable, easy to use, and avoids the shortcomings of prior art devices.

OBJECTS OF THE INVENTION

The present invention has as an object to provide a dating scheme on a food container that is readily visible to the user such that confusion between several dates is not present.

It is also an object of the present invention to provide a dating scheme on a food container lid that is simple to use and allows a user to easily change the date on a container, yet is not easily changeable by accident or by incidental movement of the lid.

It is also an object of the present invention to provide a compact dating scheme on a food container lid that can be used on smaller sized containers and non-circular containers.

It is also an object of the present invention to provide a dating scheme on a food container lid that can be easily removed for cleaning.

It is also an object of the present invention to provide a dating scheme on a food container lid that is durable and easily replaceable.

It is also an object of the present invention to provide a food storage container constructed of substantially transparent material so that the user is aware of the exact contents of the container without having to open it, thus protecting the contents from exposure.

It is also an object of the present invention to provide a food storage container that has a curved bottom surface to allow for the stacking of a plurality of such containers.

It is still a further object of the present invention to provide a lid with a dating scheme usable on existing bowls, plastic containers, or the like.

SUMMARY OF THE INVENTION

The present invention provides a datable food storage container which includes a vessel and lid, the lid containing a cavity for holding a dating mechanism. The present invention alternatively provides for a lid construction containing a cavity for holding a dating mechanism, the lid being adapted for use on plastic food storage containers, storage vessels, bowls, or the like that a user might already have (which may or may not have existing lids), such as plastic food storage containers sold under the trademarked names Rubbermaid® or Tupperware®. The dating mechanism of the present invention, for both the complete food storage container and the "lid only" embodiment, comprises a plurality of indicia carrying wheels having generally circular body members, said body members having a generally cylindrical indicia carrying surface, wherein said plurality of indicia carrying wheels are rotatable about a common axis, and means are provided for releasably holding said plurality of indicia carrying wheels in various fixed positions.

A BRIEF DESCRIPTION OF THE DRAWINGS

Figure 4:
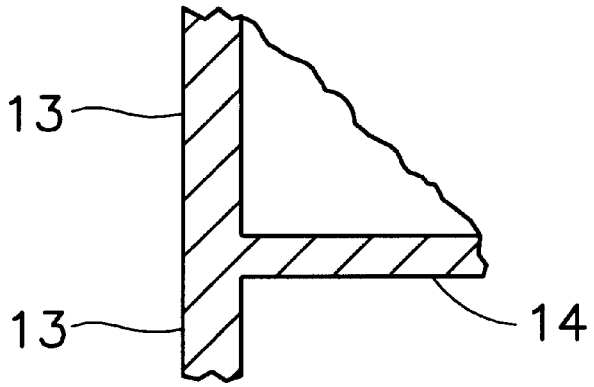
Figure 5:
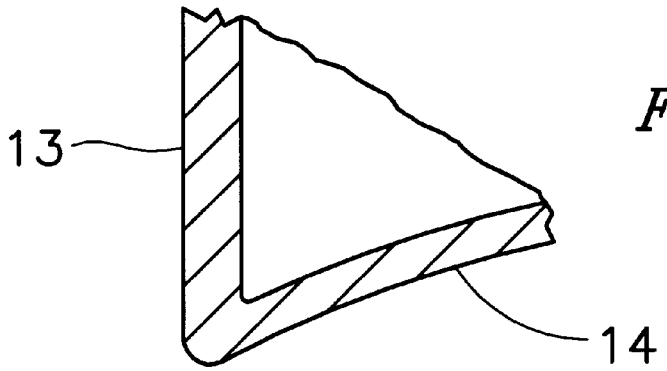
Figure 6:
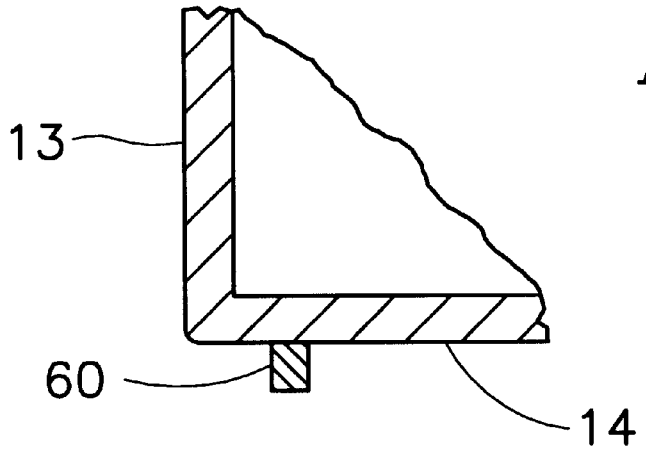

FIGS. 4, 5, and 6 are detailed elevation views of lower portions of food storage vessels in accordance with the invention, showing some alternatives for forming a cavity below the vessel bottom.

DETAILED DESCRIPTION OF THE PREFERRED EMBODIMENT

Figure 1:
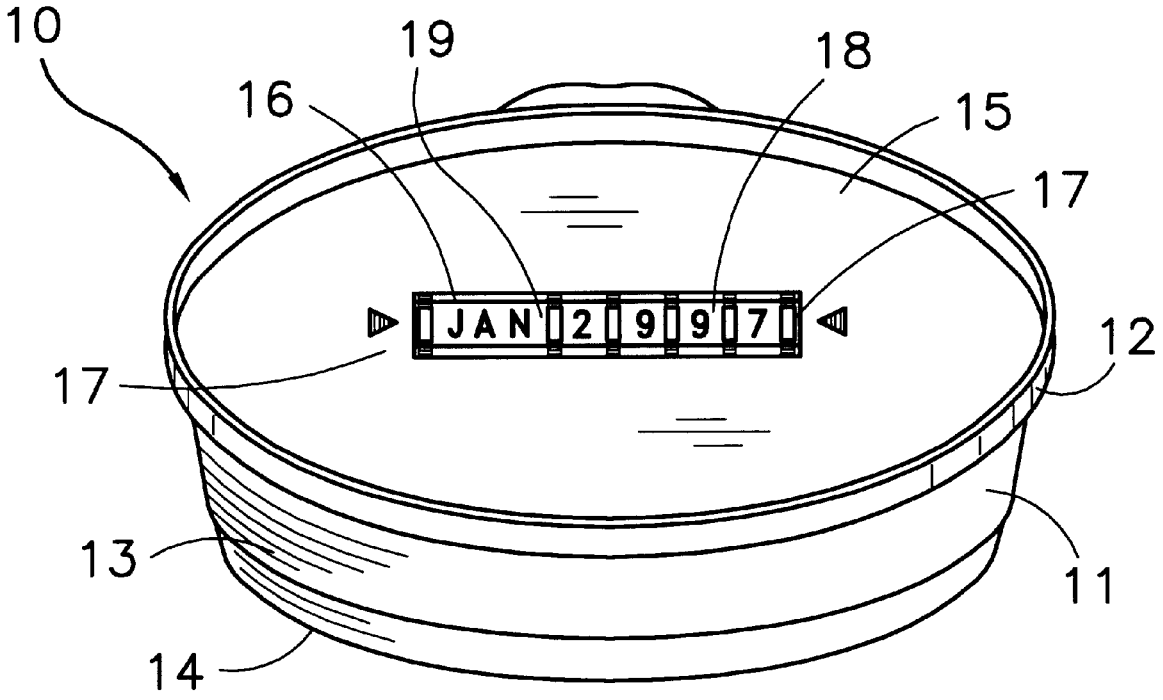
FIG. 1 is a top perspective view of a food container that embodies a food storage vessel and lid with dating mechanism in accordance with the invention.

With reference to FIG. 1, the datable food storage container 10 in accordance with the invention is shown. The container 10 comprises a vessel 11 having an upper mouth-defining structure 12, substantially upright walls 13, and a vessel bottom 14; a lid 15 having continuous top and bottom surfaces, said lid 15 having a cavity 16 having its opening in said top surface of said lid, the cavity being capable of releasably holding a dating mechanism 18. The dating mechanism 18 comprises a plurality of indicia carrying wheels 19 having generally circular body members, said body members having a generally cylindrical indicia carrying surface, wherein said plurality of indicia carrying wheels are rotatable about a common axis parallel to the top surface of said lid by an operator's fingers using said indicia carrying surface, and having means for releasably holding said plurality of indicia carrying wheels in various fixed positions.

Figure 2:
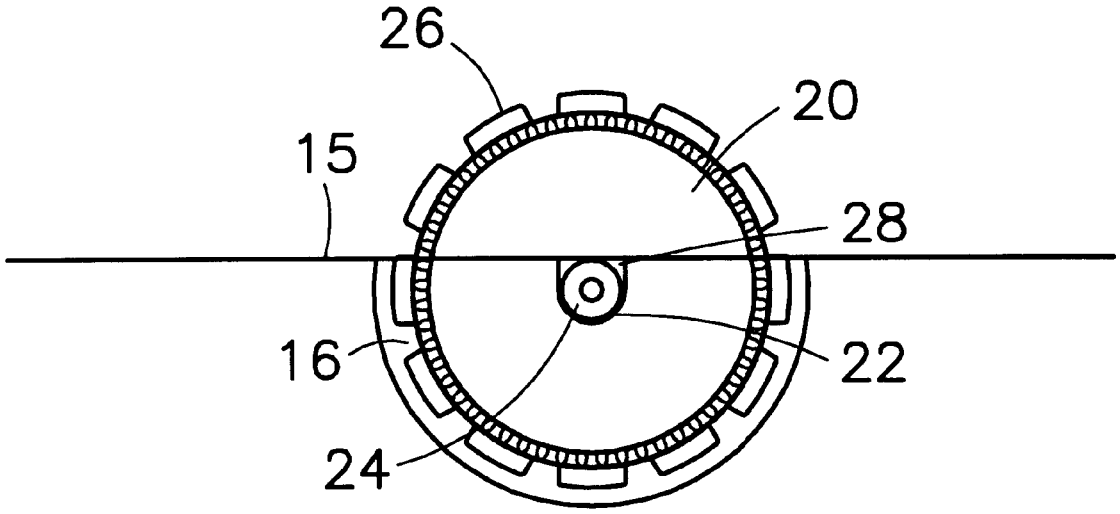
FIG. 2 is a side elevation view of a food container lid that embodies a food storage vessel lid cavity with dating mechanism in accordance with the invention.

With reference to FIG. 2, each indicia carrying wheel 19 comprises a cylindrical body 20 having a hole 22 through its axis of rotation which is adapted to receive shaft 24. Since the dating mechanism of the present invention may be subject to movement or vibration which may tend to cause the wheels to rotate, means are necessary for releasably holding said plurality of indicia carrying wheels in various fixed positions. One such means is to have the hole 22 in body 20 of wheels 19 be slightly smaller in diameter than shaft 24 to resist but not prevent manual rotation of wheel 19 about shaft 24. To permit such resistance, wheel 19 and shaft 24 can be fabricated from a resilient material such as polystyrene or other plastic material. One skilled in the art will appreciate that many other different means may be employed to permit the wheels on the dating mechanism to be releasably held, yet resistant to unintended movements or vibrations. Such means are commonly found on combination lock mechanisms found on bicycle locks or briefcases, and may include using various frictional methods including using ratchet wheels and pawls, or using wheels with notches or grooves that are capable of being engaged by resilient tongues, resilient prongs, resilient lugs, or other resilient element capable of releasably holding the wheels in place. Examples of means for releasably holding rotating wheels can be found in U.S. Pat. Nos. 2,296,551 and 3,776,177, which are hereby incorporated by reference as if fully set forth herein.

The outer cylindrical surface of each wheel 19 is provided with indicia 26 imprinted or impressed thereon. In one embodiment, each wheel 19 is imprinted with calendar material. The first wheel 19 is imprinted with the names of the months of the year in chronological order. The next wheel 19 to the right is imprinted on its face in numerical order with the numbers 0, 1, 2, 3, 0, 1, 2, 3, and blank. Each of the last three wheels 19 to the right is imprinted upon its face with the numbers 0, 1, 2, 3, 4, 5, 6, 7, 8, and 9. The indicia are preferably equally spaced around the surface of the wheels 19. Spacers may be used between wheels as desired to separate the different indicia, or alternatively spaces can be incorporated on the wheels themselves. One skilled in the art will appreciate that many different types and combinations of indicia may be used to display calendar material, including using numerals to represent the month of the year rather than the names of the months (e.g., using 12 instead of December), and using days of the week (e.g. Monday, Tuesday, etc.) in addition to other calendar information. For example, the dating mechanism may simply contain information concerning the day of the week and the date of the month (e.g. Tuesday 11), which may be sufficient to inform a user about when the contents were put into a container. Thus, the indicia can be any combination of numbers, letters, or symbols sufficient to inform a user about when the contents were put into a container.

The width of wheel 19 is preferably slightly less than the width of the cavity 16, in order to provide sufficient clearance to permit wheel 19 to rotate freely within cavity 16. As one skilled in the art will appreciate, the width of cavity 16 can be sized as needed to permit a user to easily remove the dating mechanism 18 from the lid construction. In addition, the opening of lid 15 cavity 16 must be deep enough to provide sufficient clearance for wheel 19 to rotate about shaft 24. As one skilled in the art will further appreciate, the opening of cavity 16 can be made deep enough to completely house the entire dating mechanism, such that the dating mechanism does not extend above the plane formed by the top surface of the lid 15. Such an embodiment would allow for stable stacking of a plurality of datable food storage containers.

Figure 3:
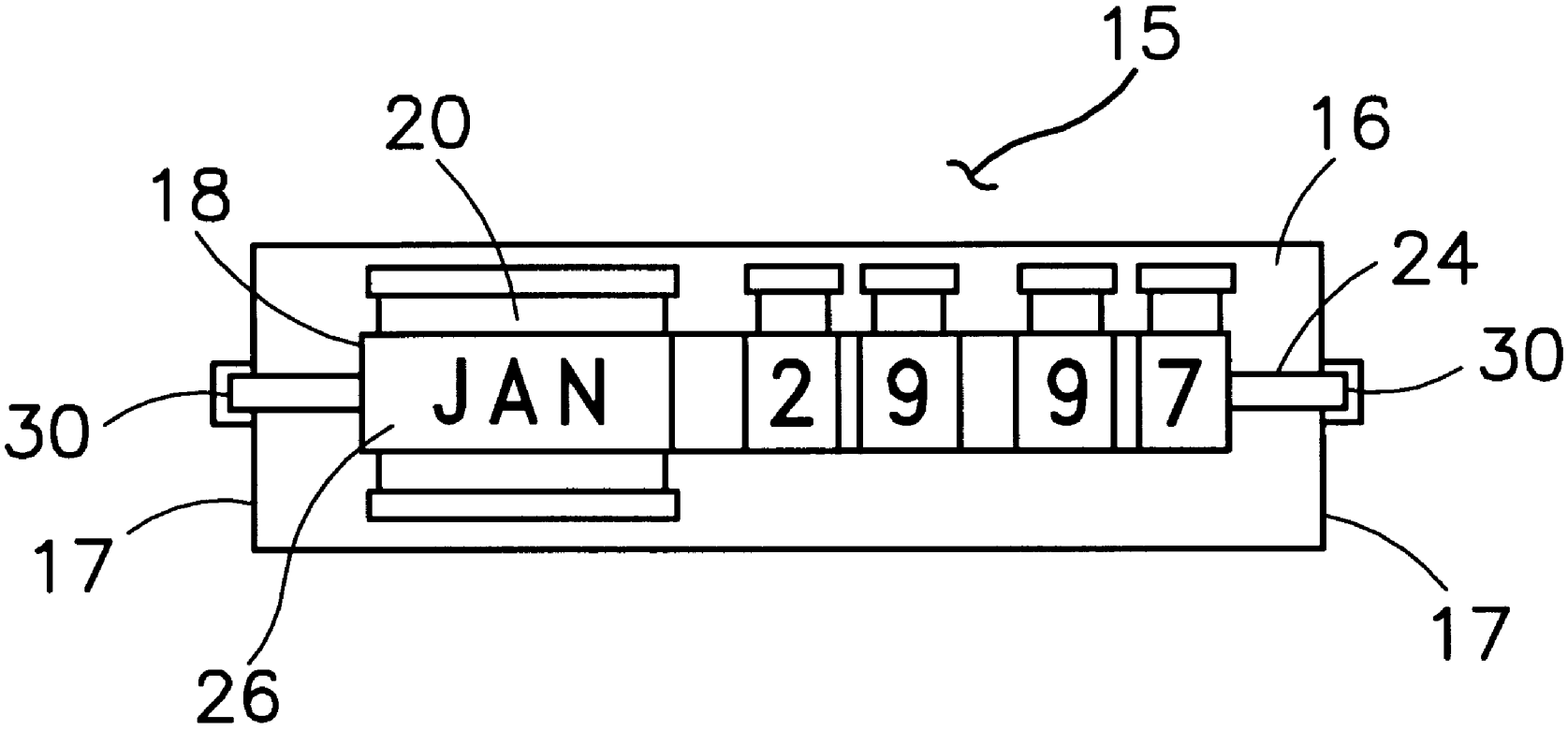
FIG. 3 is a detailed top perspective view of a dating mechanism and cavity area of a food container lid that embodies a food storage vessel lid cavity with dating mechanism in accordance with the invention.

For proper operation of the date mechanism of the present invention, date mechanism 18 must be prevented from rotating within the cavity 16, except when a user is changing the indicia. This may be accomplished in a number of ways. In an embodiment as shown in FIGS. 2 and 3, semi-cylindrical grooves 28 may be formed on the sides 17 of cavity 16, the grooves being adapted to receive the ends 30 of shaft 24. The grooves may be reduced in diameter to provide, in effect, a "shrink fit" about the ends 30 of shaft 24. In an alternative embodiment, the shaft 24 may have a single or plurality of flat surfaces on its ends, and the grooves on the sides 17 of cavity 16 may be adapted to receive the end 30 of the shaft 24 such that the flat surface(s) on the ends of said shaft prevent the dating mechanism from rotating within the lid cavity. Said grooves may be semi-cylindrical to accomplish this function. In another alternative embodiment, the bottom of the lid cavity may simply be contoured to releasably hold the dating mechanism in place. One skilled in the art will appreciate that many other different methods may be employed to prevent the dating mechanism from rotating within the lid cavity in the absence of direct user force while still allowing for removal of the dating mechanism from the lid. As can be appreciated, a user's ability to easily remove and insert the dating mechanism into the lid cavity greatly improves the utility of the present invention, enabling a user to remove the dating mechanism for cleaning or other purposes, or to replace a defective dating mechanism.

The datable food container of the present invention may also comprise other features that increase its utility. For example, a vessel bottom 14 in accordance with the invention preferably has a cavity large enough to allow one datably food storage container to sit stably upon the top of a second datable food storage container. The cavity can be formed in numerous ways, including embodiments shown in FIG. 5 wherein the vessel bottom 14 is concave, the embodiment shown in FIG. 4 wherein vessel walls 13 extend past the vessel bottom 14 to form a flange and cavity extending below the vessel bottom, and the embodiment shown in FIG. 6 wherein the vessel further includes a base 60 extending below vessel bottom 14 to form a cavity between the vessel bottom 14 and the surface on which the vessel is placed. Additionally, the vessel, the lid, and the dating mechanism are preferably constructed from materials able to withstand freezing and microwave heating, thereby allowing a user to place the container in the freezer and to reheat food within the container. The vessel and lid are preferably constructed from substantially transparent material (such as plastic), allowing a user to view the contents of the container without having to open it. Alternatively, the vessel and lid may be opaque. The vessel and lid may be constructed from non-colored materials, or may be constructed from colored materials in appealing decorative colors, in either the transparent or opaque embodiments.

Though the invention has been described with reference to specific embodiments, changes, modifications, omissions, and variations may be made without departing from the spirit and scope of the invention defined in the appended claims.

What is claimed is:

1. A datable food storage container comprising:

(a) a vessel having an upper mouth-defining structure, a vessel wall and a vessel bottom;

(b) a lid fixable to said upper mouth defining structure, said lid having a top surface and a bottom surface, said lid having a lid cavity in said top surface; and (c) a dating mechanism positioned in said lid cavity and releasably engaged with said lid, said dating mechanism comprising:

a plurality of generally cylindrical body members fixably rotatable about a common axis substantially parallel to said top surface of said lid, each of said body members having an outer surface which carries indicia, and a tubular shaft releasably and directly engaged with said lid and extending through said cylindrical body members along said common axis such that said body members are fixably rotatable about said shaft.

2. The datable food storage container of claim 1, wherein said plurality is five and said indicia is alphanumeric.

3. The datable food storage container of claim 1, wherein said indicia are capable of forming an alphanumeric sequence corresponding to a calendar date.

4. The datable food storage container of claim 1, wherein said indicia on one of said generally cylindrical body members identifies a month.

5. The datable food storage container of claim 1, wherein said indicia on two of said generally cylindrical body members identifies a month.

6. The datable food storage container of claim 1, wherein said indicia on two of said generally cylindrical body members identifies a date of a month.

7. The datable food storage container of claim 1, wherein said indicia on one of said generally cylindrical body members identifies a year.

8. The datable food storage container of claim 1, wherein said indicia on two of said generally cylindrical body members identifies a year.

9. The datable food storage container lid of claim 1, wherein said indicia on one of said generally cylindrical body members identifies a day of the week.

10. The datable food storage container of claim 1, wherein said vessel bottom forms a bottom cavity large enough to allow said vessel to sit stably upon a lid of another datable food storage container.

11. The datable food storage container of claim 1, wherein said vessel walls extend beyond said vessel bottom to form a flange, wherein said flange and said vessel bottom form a cavity large enough to allow said vessel to sit stably upon a lid of another datable food storage container.

12. The datable food storage container of claim 1, wherein said vessel further comprises a base that extends beyond said vessel bottom to form a flange, wherein said flange and said vessel bottom form a cavity large enough to allow said vessel to sit stably upon a lid of another datable food storage container.

13. The datable food storage container of claim 1, wherein said vessel, said lid, and said dating mechanism are constructed from materials able to withstand freezing and microwave heating.

14. The datable food storage container of claim 1, wherein said vessel and said lid are constructed from substantially transparent material.

* * * * *